US009428821B2

(12) United States Patent
Bridgeman et al.

(10) Patent No.: US 9,428,821 B2
(45) Date of Patent: Aug. 30, 2016

(54) GOLD ALLOYS

(75) Inventors: Todd Cleabert Bridgeman, Faribault, MI (US); Suzanne M. Dauck, Owatonna, MI (US)

(73) Assignee: Jostens, Inc., Minneapolis, MN (US)

( * ) Notice: Subject to any disclaimer, the term of this patent is extended or adjusted under 35 U.S.C. 154(b) by 0 days.

(21) Appl. No.: 12/778,868

(22) Filed: May 12, 2010

(65) Prior Publication Data

US 2010/0322818 A1 Dec. 23, 2010

Related U.S. Application Data

(60) Provisional application No. 61/177,447, filed on May 12, 2009.

(51) Int. Cl.

| | |
|---|---|
| ***C22C 9/00*** | (2006.01) |
| ***C22C 30/02*** | (2006.01) |
| ***C22C 5/00*** | (2006.01) |

(52) U.S. Cl.

CPC *C22C 9/00* (2013.01); *C22C 30/02* (2013.01)

(58) Field of Classification Search

CPC ..... C22C 5/00; C22C 5/02; C22C 5/06; C22C 5/08; C22C 9/00; C22C 30/00

USPC ..... 148/430–436; 420/469–512, 580–589

See application file for complete search history.

(56) References Cited

U.S. PATENT DOCUMENTS

| | | | | |
|---|---|---|---|---|
| 2,259,668 | A | 10/1941 | Jakob | |
| 3,925,073 | A | 12/1975 | Kohrn et al. | |
| 4,247,602 | A | 1/1981 | Krug et al. | |
| 4,264,359 | A | 4/1981 | Harris et al. | |
| 4,446,102 | A * | 5/1984 | Bales | 420/507 |
| 4,804,517 | A * | 2/1989 | Schaffer et al. | 420/587 |
| 4,973,446 | A | 11/1990 | Bernhard et al. | |
| 4,992,297 | A * | 2/1991 | van der Zel | 427/2.27 |
| 5,037,708 | A | 8/1991 | Davitz | |
| 5,045,411 | A * | 9/1991 | Taylor et al. | 428/672 |
| 5,552,225 | A * | 9/1996 | Ho | 428/403 |
| 5,558,833 | A | 9/1996 | Zamojski | |
| 5,599,406 | A * | 2/1997 | Prasad et al. | 148/436 |
| 5,882,441 | A | 3/1999 | Davitz | |
| 6,139,652 | A | 10/2000 | Carrano et al. | |
| 6,260,383 | B1 | 7/2001 | Warren et al. | |
| 6,406,664 | B1 | 6/2002 | Diamond | |
| 6,726,877 | B1 | 4/2004 | Eccles | |
| 6,841,012 | B2 | 1/2005 | Croce | |
| 7,128,871 | B2 | 10/2006 | Davitz | |
| 7,258,689 | B2 | 8/2007 | Salvo | |
| 7,354,471 | B2 | 4/2008 | Hampden-Smith et al. | |
| 2003/0012679 | A1 * | 1/2003 | Poliero et al. | 420/507 |
| 2006/0144476 | A1 | 7/2006 | Eccles | |
| 2007/0181224 | A1 * | 8/2007 | Marya et al. | 148/400 |
| 2008/0069722 | A1 | 3/2008 | Johns | |
| 2009/0185945 | A1 * | 7/2009 | Thielemann | 420/483 |
| 2010/0047618 | A1 | 2/2010 | Rostagno | |
| 2010/0193088 | A1 * | 8/2010 | Chen et al. | 148/607 |
| 2010/0209287 | A1 * | 8/2010 | Bennett | 420/476 |

FOREIGN PATENT DOCUMENTS

| | | | | |
|---|---|---|---|---|
| CN | 101218361 A | | 7/2008 | |
| EP | 1065288 A1 | * | 1/2001 | C22C 5/02 |
| GB | 508669 A | | 7/1939 | |
| GB | 2438198 A | | 11/2007 | |
| JP | 57-152437 | * | 9/1982 | C22C 9/00 |
| JP | 2000079008 A | | 3/2000 | |
| JP | 2001040438 A | | 2/2001 | |
| WO | 2004087996 A1 | | 10/2004 | |
| WO | 2008067815 A2 | | 6/2008 | |

OTHER PUBLICATIONS

Professional translation of JP 57-152437, originally published in the Japanese language on Sep. 20, 1982.*

RD176004, Dec. 1978.*

A.F. Mills and B.H. Chang, "Error Analysis of Experiments: A Manual for Engineering Students," University of California, 2004, pp. 1-49.*

Mozgovoy et al. "Investigation of mechanical, corrosion and optical properties of an 18 carat Au-Cu-Si-Ag-Pd bulk metallic glass", Intermetallics 18, Dec. 2010, pp. 2289-2291.

Ntukogu et al. "Effect of Palladium on the Tarnishing of Cu-Ag-Au Alloys", Journal of the Less Common Metals, vol. 125, Nov. 1986, pp. 197-205.

"The Essential Guide to the U.S. Trade in Gold and Silver Jewelry", Jewelers Vigilance Committee, New York, New York, 2008, 10 pages.

* cited by examiner

*Primary Examiner* — Scott Kastler

*Assistant Examiner* — Vanessa Luk

(74) *Attorney, Agent, or Firm* — Winthrop & Weinstine, P.A.

(57) ABSTRACT

A gold alloy having, expressed by weight, about 24.5 to 25.5% Au, about 19.0 to 23.0% Ag, about 43.0 to 47.0% Cu, about 6.0 to 10.0% Zn, about 0.05 to 0.30% Si, and about 0.005 to 0.03% Ir. Alternatively, a alloy having, expressed by weight, about 16-17% Au, about 19-23% Ag, about 50-55% Cu, about 6-10% Zn, about 0.05-0.30% Si, and about 0.005-0.03% Ir.

10 Claims, No Drawings

GOLD ALLOYS

CROSS REFERENCE TO RELATED APPLICATIONS

This application claims the benefit of U.S. Patent Application No. 61/177,447, filed May 12, 2009, the contents of which are hereby incorporated in their entirety by reference.

BACKGROUND

Gold alloys, particularly 14 karat gold and 10 karat gold are widely used in the manufacture of rings and other articles of jewelry. The properties and characteristics of such gold alloys, such as, for example, color, tarnish resistance, corrosion resistance, workability, and castability are highly desired for jewelry purposes.

The cost of the gold for such alloys accounts for a substantial portion of the overall manufacturing costs. Therefore, a gold alloy having a reduced gold content, which has the properties, characteristics, and appearance of gold alloys of higher gold content is desirable.

SUMMARY

A low or very low karat gold alloy which exhibits the appearance and physical properties of 10 karat or higher gold alloys. The alloy may have, expressed by weight, about 24.5 to 25.5% Au, about 19.0 to 23.0% Ag, about 43.0 to 47.0% Cu, about 6.0 to 10.0% Zn, about 0.05 to 0.30% Si, and about 0.005 to 0.03% Ir. Alternatively, the alloy may have, expressed by weight, about 16-17% Au, about 19-23% Ag, about 50-55% Cu, about 6-10% Zn, about 0.05-0.30% Si, and about 0.005-0.03% Ir.

DETAILED DESCRIPTION

The illustrative embodiments described in the detailed description, and the claims are not meant to be limiting. Other embodiments may be utilized, and other changes may be made, without departing from the spirit or scope of the subject matter presented herein. It will be readily understood that the aspects of the present disclosure, as generally described herein, may be arranged, substituted, combined, separated, and designed in a wide variety of different configurations, all of which are explicitly contemplated herein.

In some embodiments, this disclosure is drawn, inter alia, to gold alloys having a reduced gold content, and thus reduced cost, relative to conventional gold alloys for use in the manufacture of rings and other jewelry articles. As will be appreciated by those skilled in the art, a gold alloy of less than about 10 karats may be referred to as a low karat gold alloy and a gold alloy of less than about 8 karats may be referred to as a very low karat gold alloy. In various embodiments, the present disclosure may relate to about 4-9 karat gold alloys, and more particularly, about 4-8 karat gold alloys which have the appearance, properties, and characteristics substantially similar to gold alloys having a gold content of 10 karats or higher. For example, the about 4-9 karat gold alloys described herein may have any or all of a color, tarnish resistance, corrosion resistance, hardness, workability, and castability, that is substantially similar to gold alloys having a gold content of 10 karats or higher. Additionally, for example, the about 4-9 karat gold alloys described herein are of sufficient hardness to take a normal jewelry finish. In various embodiments, the gold alloys may be suited for the casting of jewelry articles such as rings, bracelets, earrings, and the like.

Alloys as disclosed herein may be formulated to have a relatively dense grain structure. For example, such that the grains of the alloy are generally tightly packed. Generally, a dense grain structure facilitates castability of the alloy by enhancing the alloys ability to go from a molten state to a solid state. Suitable grain size for the alloys may range from about 880 to 930 μm.

More specifically, in one embodiment, a low or very low karat gold alloy may be provided herewith having a CIELab coordinate values of about 89.0 to 90.0 L, about 1.5 to 2.5 a, about 17.5 to 18.5 b, about 17.5 to 19.0 c, and about 34.0 to 35.5 YI. In another embodiment, a low or very low karat gold alloy may be provided herewith having a tarnish-resistance values of about 15 to 30 DE by sulfur and about 35 to 45 DE by chlorine. In some embodiments, a low karat or very low karat gold alloy may be provided having an annealed hardness of about 120 to 130 $HV_{0,2}$ (when annealed by heating to a temperature of about 600° C. in a non-oxidizing atmosphere, held at that temperature for about 30 minutes, and then quenched in water) or about 130 to 180 $HV_{0,2}$ when age hardened (by heating to a temperature of about 250° C., held at that temperature for about ninety minutes, and then allowed to cool to room temperature). In yet further embodiments, a low or very low karat gold alloy may be provided having a tensile strength value of about 470 to 515 $N/mm^2$, a yield strength value of about 345 to 365 $N/mm^2$, and an elongation value of about 22 to 25 A %. In still further embodiments, a low or very low karat gold alloy may be provided having a grain size of about 880 to 930 μm.

In some embodiments, a low karat gold alloy may have, expressed by weight, about 37-38% gold (Au), about 13-17% silver (Ag), about 36-42% copper (Cu), about 6-10% zinc (Zn), about 0.05-0.30% silicon (Si), and about 0.005-0.03% iridium (Ir).

In various embodiments, a low karat gold alloy may have, expressed by weight, no less than about 37% Au, about 13% Ag, about 36% Cu, about 6% Zn, about 0.05% Si, and about 0.005% Ir.

In some embodiments, a low karat gold alloy may have, expressed by weight, about 33-34% Au, about 14-18% Ag, about 39-43% Cu, about 6-10% Zn, about 0.05-0.30% Si, and about 0.005-0.03% Ir.

In various embodiments, a low karat gold alloy may have, expressed by weight, no less than about 33% Au, about 14% Ag, about 39% Cu, about 6% Zn, about 0.05% Si, and about 0.005% Ir.

In some embodiments, a very low karat gold alloy may have, expressed by weight, about 28.5-29.5% Au, about 15-19% Ag, about 43-47% Cu, about 6-10% Zn, about 0.05-0.30% Si, and about 0.005-0.03% Ir.

In various embodiments, a very low karat gold alloy may have, expressed by weight, no less than about 28.5% Au, about 15% Ag, about 43% Cu, about 6% Zn, about 0.05% Si, and about 0.005% Ir.

In illustrative embodiments, a very low karat gold alloy may have, expressed by weight, about 24.5-25.5% Au, about 19-23% Ag, about 43-47% Cu, about 6-10% Zn, about 0.05-0.30% Si, and about 0.005-0.03% Ir.

In one embodiment, a very low karat gold alloy may have, expressed by weight, no less than about 24.5% Au, about 19% Ag, about 43% Cu, about 6% Zn, about 0.05% Si, and about 0.005% Ir.

In some embodiments, a very low karat gold alloy may have, expressed by weight, about 24.5-25.5% Au, about 19-23% Ag, about 33-37% Cu, about 6-10% Zn, about 6-10% Palladium (Pd), about 0.05-0.30% Si, and about 0.005-0.03% Ir.

In various embodiments, a very low karat gold alloy may have, expressed by weight, no less than about 24.5% Au, about 19% Ag, about 33% Cu, about 6% Zn, about 6% Pd, about 0.05% Si, and about 0.005% Ir.

In some embodiments, a very low karat gold alloy may have, expressed by weight, about 20-21% Au, about 21-25% Ag, about 45-49% Cu, about 6-10% Zn, about 0.05-0.30% Si, and about 0.005-0.03% Ir.

In various embodiments, a very low karat gold alloy may have, expressed by weight, no less than about 20% Au, about 21% Ag, about 45% Cu, about 6% Zn, about 0.05% Si, and about 0.005% Ir.

In illustrative embodiments, a very low karat gold alloy may have, expressed by weight, about 16-17% Au, about 19-23% Ag, about 50-55% Cu, about 6-10% Zn, about 0.05-0.30% Si, and about 0.005-0.03% Ir.

In one embodiment, a very low karat gold alloy may have, expressed by weight, no less than about 16% Au, about 21% Ag, about 53% Cu, about 8% Zn, about 0.15% Si, and about 0.01% Ir.

In some embodiments, a very low karat gold alloy may have, expressed by weight, about 16-17% Au, about 25-29% Ag, about 45-49% Cu, about 6-10% zinc Zn, about 0.05-0.30% Si, and about 0.005-0.03% Ir.

In various embodiments, a very low karat gold alloy may have, expressed by weight, no less than about 16% Au, about 25% Ag, about 45% Cu, about 6% Zn, about 0.05% Si, and about 0.005% Ir.

In some embodiments, one or more elements may be substituted for any of the elements of the aforementioned alloys. For example, either or both of rhenium and boron may be substituted for iridium. As an additional example, phosphorus may replace silicon. As another example, a portion of the zinc, such as up to 50% of the zinc, may be replaced with silver. As yet another example, copper and silver may be substituted for one another. As will be appreciated by those skilled in the art, the substitution of copper for silver may be carried out when a rose colored alloy is desired, and the substitution of silver for copper for carried out when white/less-yellow colored alloy is desired. Generally, increasing percentages of silver and or zinc can shift color to a green-yellow while increasing percentages of gold and copper can shift color to a rose or copper color. Alternatively, any elements recognized by those skilled in the art as suitable substitutes for any of the listed element may be substituted for the elements of the aforementioned alloys without deviating from the scope of the present disclosure.

In illustrative embodiments, additional elements may be added to the aforementioned alloys without deviating from the scope of the present disclosure. For example, to improve the tarnish resistive properties of the alloys, palladium may be added to any or all of the alloys.

As provided above, in various embodiments, the gold alloys of the present disclosure may include iridium. While not intending to be limited or bound in any way by theory as to the scope of the present disclosure, iridium may be added to the alloys to improve the deoxidizing properties of the alloy during melting. Additionally, for example, the iridium may form a consistent nucleation point while the alloy is transitioning from the liquid phase to the solid phase (i.e., freezing).

In some embodiments, the low karat gold alloys of the present disclosure may be manufactured by standard procedures used in the manufacture of precious metal alloys. The alloys, which may have a melting range of between about 1300° F. and about 1650° F., may be prepared by weighing out the appropriate proportions of the elements, combining them in a suitable container, such as a crucible, and applying a heat sufficient to melt the materials. Additionally, for example, the melt may be stirred with a suitable stirring device before pouring into grain form to assure uniform alloying.

In various embodiments, a copper-silicon alloy, such as one containing about 14.7% by weight silicon, may be used as the source of silicon to be incorporated into the final alloy. The presence of silicon in the alloy may improve the castability of the alloy.

The present disclosure may further relate to a method for manufacturing gold alloys as defined above, which includes casting the constituent elements of the alloy, either in the pure state or in the alloy state, under an inert atmosphere.

The present disclosure may further relate to the use of the alloys defined above for the manufacture of jewelry by investment casting.

The present disclosure may additionally relate to a cast object comprising this alloy.

The compositions of several alloys manufactured in accordance with the present disclosure are summarized in Table I.

TABLE I

Composition of Gold Alloys
Weight %

| | | Au | Ag | Cu | Zn | Pd | Si | Ir |
|---|---|---|---|---|---|---|---|---|
| Alloy 1 | 9 Karat Gold | 37.50 | 15.48 | 38 | 8.83 | — | 0.17 | 0.02 |
| Alloy 2 | 8 Karat Gold | 33.30 | 16.68 | 41.00 | 8.83 | — | 0.17 | 0.02 |
| Alloy 3 | 7 Karat Gold | 29.00 | 17.70 | 44.28 | 8.83 | — | 0.17 | 0.02 |
| Alloy 4 | 6 Karat Gold | 25.00 | 21.00 | 44.99 | 8.82 | — | 0.17 | 0.02 |
| Alloy 5 | 6 Karat Gold (with Pd) | 25.00 | 21.00 | 36.99 | 8.82 | 8.00 | 0.17 | 0.02 |
| Alloy 6 | 5 Karat Gold | 20.80 | 23.19 | 46.99 | 8.83 | — | 0.17 | 0.02 |
| Alloy 7 | 4 Karat Gold | 16.60 | 27.39 | 46.99 | 8.83 | — | 0.17 | 0.02 |
| Alloy 8 | 4 Karat Gold | 16.65 | 21.00 | 53.31 | 8.85 | — | 0.17 | 0.02 |

EXAMPLE

Samples of Alloy 4 and Alloy 8 of Table I, and a customary 10 karat gold alloy were subjected to a hydrogen chloride tarnish test. In a first phase of the test, the samples were placed in a sealed container and exposed to hydrogen chloride vapor for 24 hours. In a second phase of the test, the samples were submerged in a hydrogen chloride solution for 24 hours. The first phase of the test had minimal affect on the samples. After the second phase of the test, a whitish-green residue appeared on the polish surface of all of the samples, the least amount of residue appearing on Alloy 8.

Samples of Alloy 4 and Alloy 8 of Table I, and a customary 10 karat gold alloy were subjected to a hydrogen sulfide tarnish test. In a first phase of the test, the samples were placed in a sealed container and exposed to hydrogen sulfide vapor for 24 hours. In a second phase of the test, the samples were submerged in a hydrogen sulfide solution for 24 hours. Alloy 4 and Alloy 8 had similar appearances to the 10 karat gold alloy after the first and second phases of the test.

Samples of Alloy 4 and Alloy 8 of Table I, and a customary 10 karat gold alloy were subjected to an abrasion test. The abrasion test involved tumbling the samples in a container of sand and observing changes in glossiness of the alloys. Generally, the abrasion test is employed to observe the relative glossiness of the alloys (i.e., how well the surface of the alloys reflects light) after its been abraded and/or scratched. It was observed that Alloy 8 performed generally better than Alloy 4 and the 10 karat gold alloy in the abrasion test. Particularly, it was observed that Alloy 8 retained its glossiness for longer than both of Alloy 4 and the 10 karat gold alloy.

Samples of Alloy 3 and Alloy 4 of Table I, and a customary 10 karat gold alloy were subjected to a wear test. The wear test was configured to simulate 2 years wearing process under ordinary life conditions. During the wear test, the samples were degreased, followed by exposure to the vapors of a corrosive solution for 2 hours at 55° C. Subsequent to vapor exposure, the samples were placed inside a tumbling machine containing coconut chips and an abrasive paste. The tumbling treatment was carried out for 5 hours at 30 RPM. With respect to both corrosion and scratching, it was observed that the customary 10 karat alloy performed better than Alloy 3 and Alloy 4. Surprisingly, it was also observed that, with respect to corrosion, Alloy 4 performed better Alloy 3 (i.e., appeared visually less corroded than Alloy 3).

The various aspects and embodiments disclosed herein are for purposes of illustration and are not intended to be limiting, with the true scope and spirit being indicated by the following claims.

What is claimed is:

1. A very low karat gold alloy comprising, expressed by weight:
no less than 24.5% Au;
no less than 19.0% Ag;
no less than 43.0% Cu;
no less than 6.0% Zn;
no less than 0.05% Si; and
no less than 0.005% Ir.

2. A very low karat gold alloy comprising, expressed by weight:
about 24.5 to 25.5% Au;
about 19.0 to 23.0% Ag;
about 43.0 to 47.0% Cu;
about 6.0 to 10.0% Zn;
about 0.05 to 0.30% Si; and
about 0.005 to 0.03% Ir.

3. The alloy of claim 2 comprising, expressed by weight:
about 25.0% Au;
about 21.0% Ag;
about 44.9% Cu;
about 8.83% Zn;
about 0.17% Si; and
about 0.02% Ir.

4. The alloy of claim 2, wherein the alloy has CIELab coordinate values of about 89.0 to 90.0 L, about 1.5 to 2.5 a, about 17.5 to 18.5 b, about 17.5 to 19.0 c, and about 34.0 to 35.5 YI.

5. The alloy of claim 2, wherein the alloy has a tarnish-resistance value of about 15 to 30 DE by sulfur and about 35 to 45 DE by chlorine.

6. The alloy of claim 2, wherein the alloy has an annealed hardness of about 120 to 130 $HV_{0,2}$ when annealed by heating to a temperature of about 600° C. in a non-oxidizing atmosphere, held at that temperature for about 30 minutes, and then quenched in water; and about 130 to 180 $HV_{0,2}$ when age hardened by heating to a temperature of about 250° C., held at that temperature for about ninety minutes, and then allowed to cool to room temperature.

7. The alloy of claim 2, wherein the alloy has a tensile strength value of about 470 to 515 $N/mm^2$.

8. The alloy of claim 2, wherein the alloy has a yield strength value of about 345 to 365 $N/mm^2$.

9. The alloy of claim 2, wherein the alloy has an elongation value of about 22 to 25 A %.

10. The alloy of claim 2, wherein the alloy has a grain size of about 880 to 930 μm.

* * * * *